US011512495B2

(12) United States Patent
Matschke

(10) Patent No.: US 11,512,495 B2
(45) Date of Patent: Nov. 29, 2022

(54) FLAT KEY PROFILE FOR A LOCK-KEY SYSTEM

(71) Applicant: Assa Abloy Sicherheitstechnik GmbH, Albstadt (DE)

(72) Inventor: Steffen Matschke, Berlin (DE)

(73) Assignee: Assa Abloy Sicherheitstechnik GmbH, Albstadt (DE)

( * ) Notice: Subject to any disclaimer, the term of this patent is extended or adjusted under 35 U.S.C. 154(b) by 154 days.

(21) Appl. No.: 16/963,560

(22) PCT Filed: Jan. 18, 2019

(86) PCT No.: PCT/DE2019/100050
§ 371 (c)(1),
(2) Date: Jul. 21, 2020

(87) PCT Pub. No.: WO2019/144990
PCT Pub. Date: Aug. 1, 2019

(65) Prior Publication Data

US 2020/0354987 A1 Nov. 12, 2020

(30) Foreign Application Priority Data

Jan. 23, 2018 (DE) ..... 102018101438.4
Sep. 27, 2018 (EP) ..... 18197124

(51) Int. Cl.
*E05B 19/00* (2006.01)

(52) U.S. Cl.
CPC ..... *E05B 19/0029* (2013.01); *E05B 19/0041* (2013.01); *E05B 19/0058* (2013.01)

(58) Field of Classification Search
CPC .. E05B 19/00; E05B 19/0017; E05B 19/0029; E05B 19/0041; E05B 19/0052; E05B 19/0058
See application file for complete search history.

(56) References Cited

U.S. PATENT DOCUMENTS 3,499,304 A * 3/1970 Naujoks ..... E05B 27/0053 70/406
5,797,287 A * 8/1998 Prunbauer ..... E05B 27/0042 70/358

(Continued)

FOREIGN PATENT DOCUMENTS

DE 3614222 6/1987
DE 9302740 4/1993

(Continued)

OTHER PUBLICATIONS

PCT Search Report PCT/DE2019/100050, dated May 21, 2019.

*Primary Examiner* — Christopher J Boswell
(74) *Attorney, Agent, or Firm* — Dekel Patent Ltd.; David Klein

(57) ABSTRACT

The invention relates to a flat key profile for a lock and key system in which a key channel corresponding to the key profile is provided in the lock cylinder. In this case, the key profile of the key shank facing the key back upper profile section and a key face facing the lower profile section, wherein in the lower profile section in a side surface of the key shank a triangular, the center plane of the key shank superior, paracentric profile groove (2) provided on the opposite side surface of the key shank one above or below the opposite paracentric profile groove (2) arranged, triangular profile groove (3; 4) is provided, the arrangement of the paracentric profile groove relative to the opposite profile groove is such that an imaginary line (7), the vertical to the keychain plane from the intersection of the upper or lower leg of the paracentric profile groove with the key side surface to the opposite profile groove extends, to an imaginary line (5) extending from the intersection of the upper or (Continued)

Figure 1:
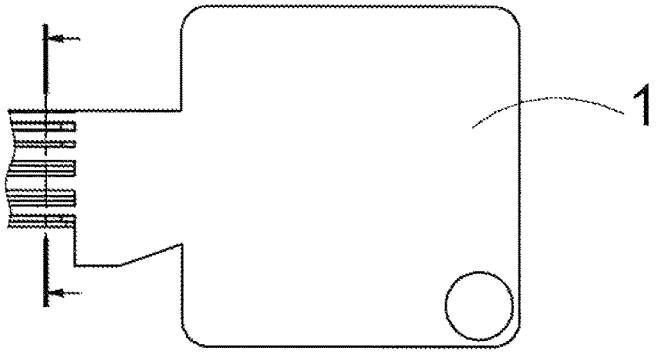

lower leg of the opposite profile groove with the key side surface extends to the paracentric profile groove, a vertical distance (9).

7 Claims, 2 Drawing Sheets

(56) References Cited

U.S. PATENT DOCUMENTS

| | | | | |
|---|---|---|---|---|
| 5,819,567 | A * | 10/1998 | Eden, Jr. | E05B 11/06 70/389 |
| 6,851,292 | B2 * | 2/2005 | Kruhn | E05B 19/0029 70/405 |
| 8,931,316 | B2 * | 1/2015 | Reine | E05B 19/0017 409/83 |
| 2004/0253067 | A1 * | 12/2004 | Bosch | B23C 3/35 409/81 |
| 2007/0295045 | A1 * | 12/2007 | Neumayer | E05B 19/0029 70/409 |

FOREIGN PATENT DOCUMENTS

| | | |
|---|---|---|
| DE | 4304604 | 8/1994 |
| EP | 1217151 | 6/2002 |
| WO | 03004806 | 1/2003 |

* cited by examiner

FLAT KEY PROFILE FOR A LOCK-KEY SYSTEM

The invention relates to a flat key profile for a lock and key system in which a key channel corresponding to the key profile is provided in the lock cylinder.

The term flat key is also understood to mean rib profile keys or locking rib profile keys, i.e., those profiles in which ribs protrude beyond the key side surface.

Keys are mimicked or copied for a variety of reasons, with a distinction being made between legal and illegal.

Copying is made more difficult by such key profiles or at least made more difficult by the fact that they are protected profiles, ie those which have been granted patent or utility model protection.

For such keys there is the possibility of reordering via the lock manufacturer or authorized locksmiths.

On the other hand, it is known that locksmiths are also able, through the use of copying machines, to produce duplicates having profiles protected on their own. However, there are profiles for which this is not so easy and therefore an approximation to the actual profile is attempted by simplifications. This includes, for example, the shape of the lateral profile grooves.

In commercial copying machines, namely, a thin circular saw blade is used, which can only make right-angled cuts in the key. If V-shaped cuts are required for the copy, only a rectangular cut can be made as a replacement.

The object of the invention is now to complicate the machine copying a key profile.

This object is achieved according to the invention by a flat key profile for a lock and key system, in which a key channel corresponding to the key profile is provided in the lock cylinder, thereby, the key profile of the key shank has an upper profile section facing the key back and a lower profile section facing the key chest, in that projecting notches are provided in the lower profile section starting from the key-breast in the key-shaft plane, a triangular, paracentric profile groove 2 projecting beyond the median plane of the key shank is provided in the lower profile section in the one side face of the key shank, a triangular profile groove arranged above or below the opposite paracentric profile groove is provided on the opposite side surface of the key shank, the profile base of which has a horizontal distance from the profile base of the opposite paracentric profile groove, the arrangement of the paracentric profile groove relative to the opposing profile grooves is such that an imaginary line perpendicular to the keychain plane from the intersection of the upper or lower leg of the paracentric profile groove with the key side surface to the opposite profile groove, to an imaginary line extending from the intersection of upper or lower leg of the opposite profile groove with the key side surface extends to the paracentric profile groove, has a vertical distance.

Preferably embodiments emerge from the subclaims.

Two opposing profile features are used, which are triangular (V-shaped). The profile features are symmetrical and have radii in their base.

If two opposing features are now arranged so that they are very close to each other with profiles milled right-angled, then the key would break in this area. The minimum overlap should be 0.2 mm and the maximum residual thickness 0.3 mm. In order to produce the triangular cuts (profile features) economically, the deeper notch should have an angle of a=110°.

There must be at least two incisions that are offset from each other. Starting from the deeper incision, either "above" or "below" this one further incision must be present.

Since, as mentioned above, the copying machine with a rectangular milling disc cannot produce a V-shaped profile groove, the profile groove must be milled rectangular as a replacement, whereby it is inevitably wider.

Since, however, according to the invention further arrangement relationships or features must be taken into account, this leads to the key shank becoming too thin at certain points, so that it breaks during the copying process or at the latest during use.

Thus, the disadvantage of mechanical profile copying machines is exploited, so that the copied key is not usable. Even copying with 3D filament printers is made much more difficult by the bevels, as here the bevels can only be generated stepwise.

The invention will be explained in more detail with reference to the drawings.

Figure 2:
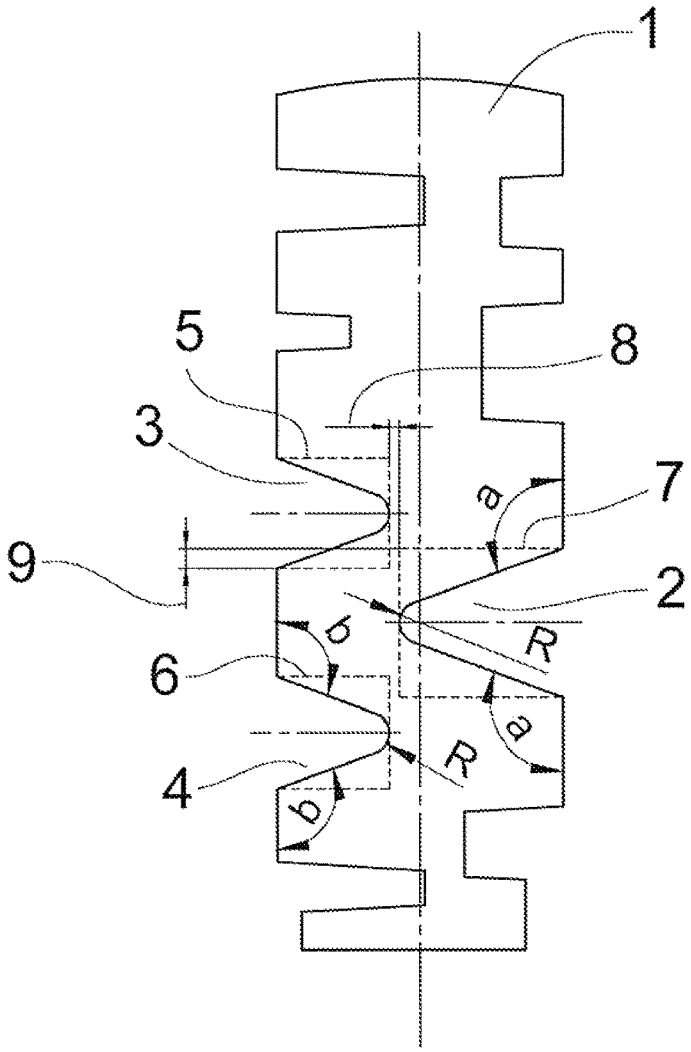

Showing:

FIG. 1 a partial side view of a key with head and profiled shaft,

FIG. 2 a cross section through the profiled shaft and

Figure 3:
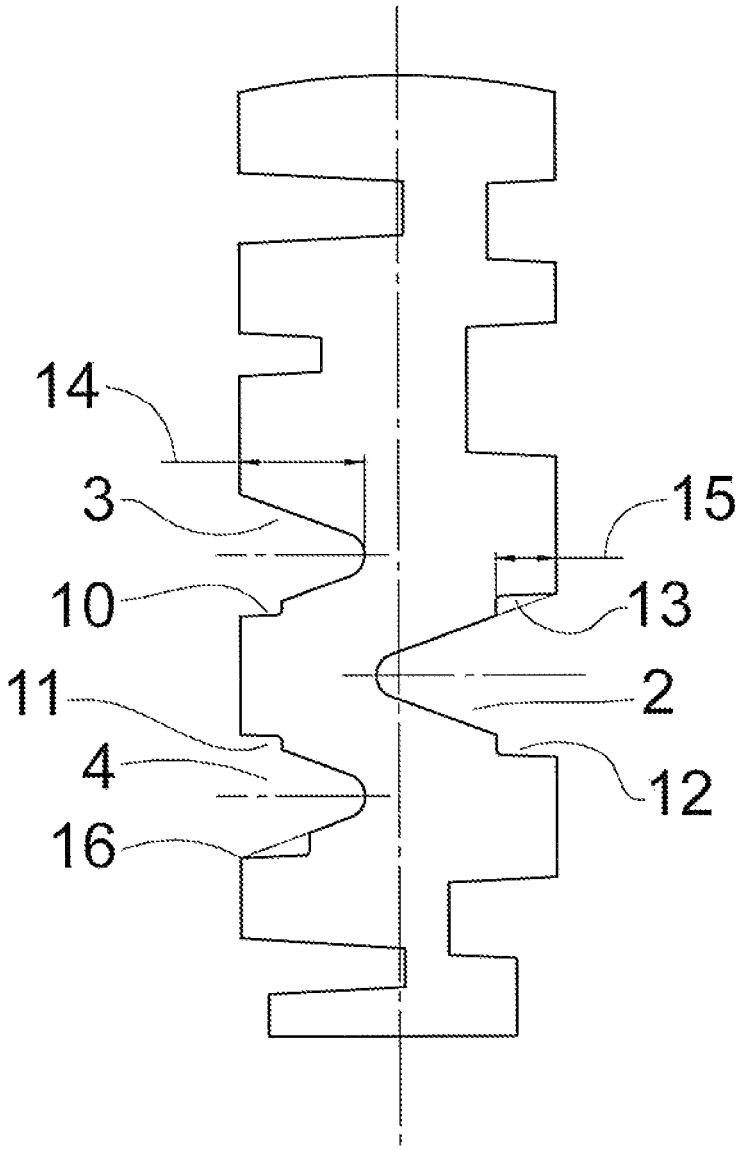

FIG. 3 a modified embodiment in cross section.

The key shaft is labeled 1. From the key side surface, the deeper profile groove 2 goes out, which extends paracentrally over the median plane. The profile groove 2 is formed symmetrically and has the angle alpha ($\alpha$). Likewise, the profile grooves are formed "over" and "under" the profile groove 2 on the other key side. These are marked 3 and 4 and have an angle beta ($\beta$). At the bottom of the incisions, there is a radius (R). To the three incisions each with dashed lines 5, 6, 7 is drawn a rectangle that represents the rectangular incisions by means of a mechanical profile copying machine.

In detail, the arrangement of the paracentric profile groove with respect to the opposite profile grooves is such that an imaginary line 7, perpendicular to the key plane from the intersection of the upper or lower leg of the paracentric profile groove with the key side surface to the opposite profile groove, to an imaginary line 5, which extends from the intersection of the upper or lower leg of the opposite profile groove with the key side surface to the paracentric profile groove, a vertical distance 9 has.

This results in horizontal and vertical distances. The horizontal distance 8 should be a maximum of 0.3 mm, the vertical coverage 9 minimum 0.2 mm. The angle alpha from the deeper incision should be 110°. The radius R should be 0.2 mm. The angle beta is freely selectable according to the distances 8 and 9. The incisions (profile features) should preferably lie in the "lower" area of the key, ie in which—starting from the key breast—is notched.

The invention claimed is:

1. A key comprising:

a key shank having a length extending from a key head to a key shank end, said key shank having a profile which is a cross-section taken perpendicularly through said length;

a triangular paracentric profile groove formed in the profile of said key shank that has an open end at a first outer edge of said profile and a closed end that extends over a longitudinal center plane of said key shank;

a triangular profile groove formed in said key shank that has an open end at a second outer edge of said profile of said key shank, opposite to said first outer edge, and a closed end that does not extend over said longitudinal center plane of said key shank, wherein the closed end of said triangular profile groove is at a horizontal distance from the closed end of said triangular paracentric profile groove, horizontal being defined as extending between said first and second outer edges, and wherein a first junction of the open end of said triangular paracentric profile groove and said first outer edge is at a vertical distance from a second junction of the open end of said triangular profile groove and said second outer edge;

a first shoulder formed at said first junction comprising a first horizontal leg that extends from said first outer edge towards said longitudinal center plane of said key shank and a first vertical leg extending perpendicularly from said first horizontal leg; and a second shoulder formed at said second junction comprising a second horizontal leg that extends from said second outer edge towards said longitudinal center plane of said key shank and a second vertical leg extending perpendicularly from said second horizontal leg.

2. The key according to claim 1, wherein said second shoulder has a depth at least one third of a depth of said triangular profile groove, the depths being defined from said second outer edge towards said longitudinal center plane of said key shank.

3. The key according to claim 1, wherein said closed end of said triangular paracentric profile groove is curved.

4. The key according to claim 1, wherein said closed end of said triangular profile groove is curved.

5. The key according to claim 1, wherein an angle between legs of said triangular paracentric profile groove and said first outer edge is 110°.

6. The key according to claim 1, wherein an angle between legs of said triangular profile groove and said second outer edge is from 100° to 130°.

7. The key according to claim 1, wherein the horizontal distance is at most 0.3 mm and the vertical distance is at least 0.2 mm.

* * * * *